US006524079B1

(12) United States Patent
Kimura et al.

(10) Patent No.: US 6,524,079 B1
(45) Date of Patent: Feb. 25, 2003

(54) ALIGNMENT MEANS FOR THE SWASH PLATE OF A VARIABLE-CAPACITY SWASH-PLATE TYPE COMPRESSOR

(75) Inventors: Kazuya Kimura, Kariya (JP); Tetsuhiko Fukanuma, Kariya (JP); Masakazu Murase, Kariya (JP); Minoru Mera, Kariya (JP); Atsuyuki Morishita, Kariya (JP); Shingo Kumazawa, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/807,359

(22) PCT Filed: Jul. 27, 2000

(86) PCT No.: PCT/JP00/05039

§ 371 (c)(1),
(2), (4) Date: Apr. 12, 2001

(87) PCT Pub. No.: WO01/14743

PCT Pub. Date: Mar. 1, 2001

(30) Foreign Application Priority Data

Aug. 20, 1999 (JP) ..... 11-233472

(51) Int. Cl.[7] ..... F04B 1/12

(52) U.S. Cl. ..... 417/269; 91/499; 92/12.2

(58) Field of Search ..... 417/269, 222.2; 91/499; 74/25, 60; 92/12.2

(56) References Cited

U.S. PATENT DOCUMENTS

| | | | | |
|---|---|---|---|---|
| 4,884,952 A | * | 12/1989 | Kanamaru et al. | 417/222.2 |
| 5,259,739 A | * | 11/1993 | Terauchi | 74/60 |
| 5,370,503 A | * | 12/1994 | Terauchi | 417/222.2 |
| 5,370,505 A | * | 12/1994 | Takenaka et al. | 417/269 |
| 5,387,091 A | * | 2/1995 | Kawaguchi et al. | 417/222.2 |
| 5,694,828 A | * | 12/1997 | Umemura et al. | 417/269 |
| 5,752,809 A | * | 5/1998 | Makino et al. | 417/269 |

FOREIGN PATENT DOCUMENTS

| | | |
|---|---|---|
| JP | 07-91366 | 4/1995 |

* cited by examiner

*Primary Examiner*—Cheryl J. Tyler
(74) *Attorney, Agent, or Firm*—Morgan & Finnegan, LLP

(57) ABSTRACT

In a variable-capacity swash-plate type compressor, which can vary the outlet capacity by controlling an inclination angle of a swash plate, the swash plate is aligned by contacting a washer (19) with a tapered surface to the swash plate (18). Thus, in a case where a compression operation is not carried out or in a case where a compression operation is carried out at a small outlet capacity regarded as zero substantially, the noises, etc., which generate between the swash plate and a driving shaft (6), are inhibited.

5 Claims, 10 Drawing Sheets

ALIGNMENT MEANS FOR THE SWASH PLATE OF A VARIABLE-CAPACITY SWASH-PLATE TYPE COMPRESSOR

TECHNICAL FIELD

The present invention relates to a variable-capacity swash-plate type compressor, which is used in vehicle air-conditioning apparatuses.

BACKGROUND ART

As a conventional variable-capacity swash-plate type compressor (hereinafter, simply referred to as a compressor), a compressor has been known which is disclosed in Japanese Unexamined Patent Publication (KOKAI) No. 7-91,366. In this compressor, as illustrated in FIG. 11, cylinder bores 8 are formed in a cylinder block 1, inlet chambers 30 and an outlet chamber 31 are formed in a rear housing 3, and a crank chamber 5 is formed in the front housing 2. These front housing 2, cylinder block 1 and rear housing 3 are bonded with each other to constitute a housing.

In the crank chamber 5, a driving shaft 6 is held rotatably by the front housing 2 and the cylinder block 1 by way of bearings 7*a*, 7*b*. Onto the driving shaft 6, in-between the front housing 2, a rotor 10 is supported synchronously rotatably by way of a bearing 2*a*, and, in-between the rotor 10, a swash plate 11 is supported synchronously rotatably by way of a pair of hinge mechanisms K, K. The respective hinge mechanisms K, K include a supporting arm 17, which protrudes rearward from the rotor 10 and in which a guide hole 17*a* is drilled through, and a guide pin 16, which is fastened to a bracket 15, being disposed integrally and protrudingly in front of the swash plate 11, and which has a sphere portion 16*a*, being fitted idly into the guide hole 17*a* reciprocatably, at the leading end. The respective hinge mechanisms K, K are disposed oppositely so as to cross over the top-dead-center position T of the swash plate 11. Between the rotor 10 and the swash plate 11, an inclination-angle reducing spring 12 is interposed, and the inclination-angle reducing spring 12 urges the swash plate 11 toward the rear housing 3 in such a direction that the inclination angle reduces from the maximum inclination angle to the minimum inclination angle.

Further, in the swash plate 11, a through hole 20, into which the driving shaft 6 is fitted, is drilled through. This through hole 20, as illustrated in FIG. 12, is formed so as to permit an inclination-angle displacement of the swash plate 11 over an entire control range about a swing-shaft center Y, which is set beyond a side of the driving shaft 6, side which faces the hinge mechanisms, K, K, while interposing a shaft center X of the driving shaft 6 therebetween. Namely, this swash plate 11, as illustrated in FIG. 11, is inhibited from further inclining in the inclination-angle reducing direction by contacting a rear end surface 11*b*, which is formed as a concaved-shape at the trailing end of the through hole 20, with a circlip 13, which is engaged with the driving shaft 6, when the inclination-angle reducing spring 12 is put into the most extended state. On the contrary, the swash plate 11 is inhibited from further inclining in the inclination-angle enlarging direction by contacting a front end surface 11*a*, which is formed at the bottom in a slanted manner, with a rear end surface 10*a* of the rotor 10 when the inclination-angle reducing spring is put into the most contracted state.

And, pistons 9 are engaged with this swash plate 11 by way of a pair of shoes 14, which serve as a connecting mechanism for transforming the to-and-fro swinging movement according to the inclination angle into the reciprocating movements, and the respective pistons 9 are accommodated in the respective cylinder bores 8.

Between the cylinder block 1 and the rear housing 3, a valve plate 4, etc., are interposed. In the valve plate 4, inlet ports 32 and outlet ports 33 are formed to open correspondingly to the respective cylinder bores 8, and compression chambers, which are formed between the valve plate 4 and the pistons 9, are communicated with inlet chambers 30 and an outlet chamber 31 by way of the inlet ports 32 and the outlet ports 33. On the respective inlet ports 32, inlet valves, not shown, are disposed which open and close the inlet ports 32 in accordance with the reciprocate movements of the pistons 9, and, on the respective outlet ports 33, outlet valves, not shown, are disposed which open and close the outlet ports 33 in accordance with the reciprocate movements of the pistons 9 while being regulated by retainers 34.

Moreover, in the cylinder block 1, an air-bleeding passage, not shown, is disposed which communicates the crank chamber 5 with the inlet chambers 30, and this air-bleeding passage is opened and closed by a control valve, not shown.

In this compressor, when the rotor 10 and the swash plate 11 are rotated at a predetermined angle, accompanied by the driving of the driving shaft 6, the pistons 9 are reciprocated in the cylinder bores 8. Thus, a refrigerant gas is sucked from the inlet chambers 30 into the compression chamber, and, after the refrigerant gas is compressed, it is discharged into the outlet chamber 31. And, the inclination angle of the swash plate 11 is displaced by adjusting the pressure in the crank chamber 5 by the control valve, and thereby the outlet capacity of the refrigerant gas, which is discharged into the outlet chamber 31, is controlled.

At this moment, as illustrated in FIG. 12, when the swash plate 11 is put into the maximum inclination angle, a front lower surface 20*c* and rear upper surface 20*d* of the through hole 20 do not contact with a peripheral surface of the driving shaft 6. Moreover, when the swash plate 11 is put into the minimum inclination angle, a rear lower surface 20*e* and front upper surface 20*f* of the through hole 20 do not contact with the peripheral surface of the driving shaft 6. Namely, the through hole 20 does not define the maximum inclination angle and the minimum inclination angle, and the clearance between the through hole 20 and the driving shaft 6 is enlarged.

And, in this compressor, since a supporting portion 20*b* in the through hole 20 is formed as an arc shape, the peripheral surface of the driving shaft 6 always keeps a linear contact with the supporting portion 20*b*, and the supporting portion 20*b* is less likely to be worn. Moreover, since the moments, which result from the compression reaction force, etc., can be received almost by the pair of hinge mechanisms K, K, regulatory surfaces 20*a*, 20*a* of the swash plate 11 are also less likely to be worn. Hence, in this compressor, the inclination angle of the swash plate 11 is secured reliably, and a good durability can be effected.

However, not only in the swash-plate type compressor set forth in the aforementioned publication, but also in variable-capacity swash-plate type compressors involving wobble type ones widely, in a case where a compression operation is not carried out or in a case where a compression operation is carried out at a small outlet capacity regarded as zero substantially, it has been found out that such drawbacks take place in that noises and vibrations arise and colliding portions wear when a large vibration is applied from the exterior, drawbacks which result from the clearance of the inclination-angle variable swash plate.

Namely, in the variable-capacity swash-plate type compressors involving wobble type ones widely, the swash plate is supported by providing clearances of certain extent in-between the other members, such as the driving shaft, a sleeve, etc., so that the postures and positions, accompanied by the inclination-angle displacement, can be varied, and thereby the swash plate varies the inclination angle so that the variable capacity is realized.

Here, in a case where the compressor carries out a compression operation at a large outlet capacity, since a compression load acts onto the swash plate from the pistons, regardless of the clearances in-between the other members, the swash plate keeps contacting with the other members by the compression load at the predetermined positions. Hence, in this case, even when a large vibration is applied from the exterior, since the swash plate does not collide with the other members repeatedly, noises, etc., do not arise.

However, in the case where the compression operation is not carried out or in the case where the compression is carried out at a small outlet capacity regarded as zero substantially, the compression load does not act onto the swash plate, or hardly acts thereonto, if a large vibration is applied from the exterior, since the swash plate collides with the other members repeatedly, noises, etc., arise.

In particular, in the swash-plate type compressor set forth in the aforementioned publication, since the driving shaft, which is fitted into the through hole of the swash plate, can be the aforementioned other member, and since it is comparatively difficult to form the through hole with a high accuracy, this tendency is apparent.

DISCLOSURE OF THE INVENTION

The present invention has been done in view of the aforementioned conventional circumstances. In a variable-capacity swash-plate type compressor involving wobble type ones widely, it is an object, without obstructing the inclination-angle displacement of the swash plate accompanied by the variable capacity, to inhibit the drawbacks, such as the noises, etc., in the case where the compression operation is not carried out or in the case where the compression operation is carried out at a small outlet capacity regarded as 0 substantially.

A variable-capacity swash-plate type compressor according to the present invention, which is constituted so that a crank chamber, inlet chambers, an outlet chamber and cylinder bores connected therewith are demarcated and formed in a housing, so that pistons are accommodated reciprocatably in the respective cylinder bores, respectively, so that a rotor, positioned in said crank chamber, is supported synchronously rotatably onto a driving shaft, supported by the housing, and a swash plate, connected thereto by way of the rotor and a hinge mechanism, is fitted therewith so as to make an inclination angle variable, so that a connecting mechanism, transforming a to-and-fro swinging movement of said swash plate into reciprocating movements of the respective pistons, is interposed between the swash plate and said pistons, and so that the inclination angle of said swash plate is controlled by a pressure in said crank chamber so as to vary an outlet capacity, wherein it is characterized in that an aligning member, which contacts with said swash plate to align said swash plate, is interposed.

In the present compressor, since the aligning member contacts with the swash plate to align the swash plate, the clearances, which the swash plate has in-between the other members, such as the driving shaft, a sleeve, etc., are absorbed while making the variations of the postures and positions, accompanied by the inclination-angle displacement of the swash plate, possible. Hence, in the case where this compressor does not carry out the compression operation, or in the case where it carries out the compression operation at a small outlet capacity regarded as zero substantially, even when a large vibration is applied from the exterior, since the swash plate does not collide with the other members repeatedly, noises and vibrations do not arise, and the wears at the colliding portions are less likely to occur.

Accordingly, the present compressor can, without obstructing the inclination-angle displacement of Lhe swash plate accompanied by the variable capacity, inhibit the drawbacks, such as the noises, etc., in the case where it does not carry out the compression operation or in the case where it carries out the compression operation at a small outlet capacity regarded as 0 substantially.

As the aligning member, in a case where the driving shaft is the other member, namely, in a case where the swash plate contacts directly with the driving shaft, it is possible to employ a washer, which is fitted with the driving shaft to fill up the clearance between the swash plate and the driving shaft. Alternatively, in a case where a sleeve, which is fitted with the driving shaft, is the other member, namely, in a case where the swash plate contacts directly with the sleeve, it is possible to employ a washer, which fills up the clearance between the swash plate and the sleeve.

Further, it is suitable to provide the present compressor with an urging means, which urges this aligning member onto a swash-plate side. This is because the aligning member is moved onto the swash-plate side by the urging force of the urging means so that it is likely to fill up the clearances between the swash plate and the other members.

Furthermore, it is suitable that said aligning member is disposed between the rotor and the swash plate, and that said urging means is an inclination-angle reducing spring, which urges the swash plate in such a direction that the inclination angle is reduced from the maximum inclination angle to the minimum inclination angle.

By utilizing the inclination-angle reducing spring, it is not needed to especially dispose an urging means, which urges the aligning member only, and it is possible to realize the reduction of the product cost by reducing the number of the component parts.

Moreover, it is suitable that said aligning member is disposed on an opposite side of the rotor with respect to the swash plate, and that said urging means is a return spring, which urges the swash plate in such a direction that the inclination angle is enlarged from the minimum inclination angle to a limit angle or more.

By utilizing the return spring, it is not needed to especially dispose an urging means, which urges the aligning member only, and it is possible to realize the reduction of the product cost by reducing the number of the component parts. Note that, in this case, the aligning member is disposed on an opposite side with respect to the case where the aforementioned inclination-angle reducing spring is utilized.

In addition, it is suitable that said aligning member includes a first aligning member, which is disposed between the rotor and the swash plate, and a second aligning member, which is disposed on an opposite side of the rotor with respect to the swash plate, and that said urging means includes an inclination-angle reducing spring, which urges the first aligning member in such a direction that the inclination angle of the swash plate is reduced from the maximum inclination angle to the minimum inclination angle, and a return spring, which urges the second aligning member in such a direction that the inclination angle of the swash plate is enlarged from the minimum inclination angle to a limit angle or more.

In this case, both of the aforementioned cases are combined. By aligning the swash plate from both of the front and rear sides, without obstructing the inclination-angle displacement of the swash plate accompanied by the variable capacity, it is possible to further effectively prevent the drawbacks, such as the noises, etc., when the compression operation is not carried out or when the compression operation is carried out at a small capacity regarded as 0 substantially.

It is suitable that at least one portion, which is selected from the group consisting of a portion with which said swash plate contacts said aligning member and a portion with which said aligning member contacts said swash plate, is formed as a minor-diameter tapered surface on an inner side of the swash plate.

Thus, a minor-diameter side of the tapered surface is positioned on an inner side of the swash plate, and consequently it is likely to fill up the clearances between the swash plate and the other members.

In a case where such a tapered surface is formed on the portion with which the swash plate contacts the aligning member, it is possible to form it by using a cutting tool, which has a taper-processed surface at the leading end, so as to advance the cutting tool in two directions with respect to the swash plate, or so as to gently swing the cutting tool or the swash plate between the two directions.

In a case where both of the portion with which the swash plate contacts the aligning member and the portion with which the aligning member contacts the swash plate are formed as such tapered surfaces, it is preferred that they are formed so as to have an equal opening angle. Thus, their tapered surfaces contact superficially with each other, and accordingly it is possible to reduce the wear between both of them.

By the way, it is not necessarily easy to process both of them so as to form the tapered surfaces having an equal opening angle. On the other hand, even if the both of them are processed so as to form the tapered surfaces having an equal opening angle, after a compressor is assembled, it is likely that these tapered surfaces contact in an inclined manner because of the dimensions for the sliding movements, etc., and the dimensional tolerances, etc.

Hence, it is further suitable that one of the portion, with which the swash plate contacts the aligning member, and the portion, with which the aligning member contacts with the swash plate, is formed as a minor-diameter tapered surface on an inner side of the swash plate, and that the other one of them is formed as a convexed curved surface.

Thus, the minor-diameter side of the tapered surface is positioned on the inner side of the swash plate, not only it is likely to fill up the clearances between the swash plate and the other members, but also it is easy to carry out the processing so that it is possible to realize the reduction of the production cost.

In a case where the driving shaft is the other member, that is, in a case where the swash plate contacts directly with the driving shaft, the through hole, into which the driving shaft is fitted, is formed through in the swash plate like the compressor set forth in the aforementioned publication. This through hole is formed so as to permit an inclination-angle displacement of the swash plate over an entire control range about a swing-shaft center, which is set beyond a side of the driving shaft, side which faces the hinge mechanism, while interposing a shaft center therebetween. Since it is comparatively difficult to form such a through hole with a high accuracy, the present invention greatly exhibits the effect especially in this case. The aligning member is fitted with the driving shaft.

BEST MODE FOR CARRYING OUT THE INVENTION (First Embodiment)

Hereinafter, the First and Second Embodiments, which materialize the present invention, will be described with reference to the drawings.

Figure 1:
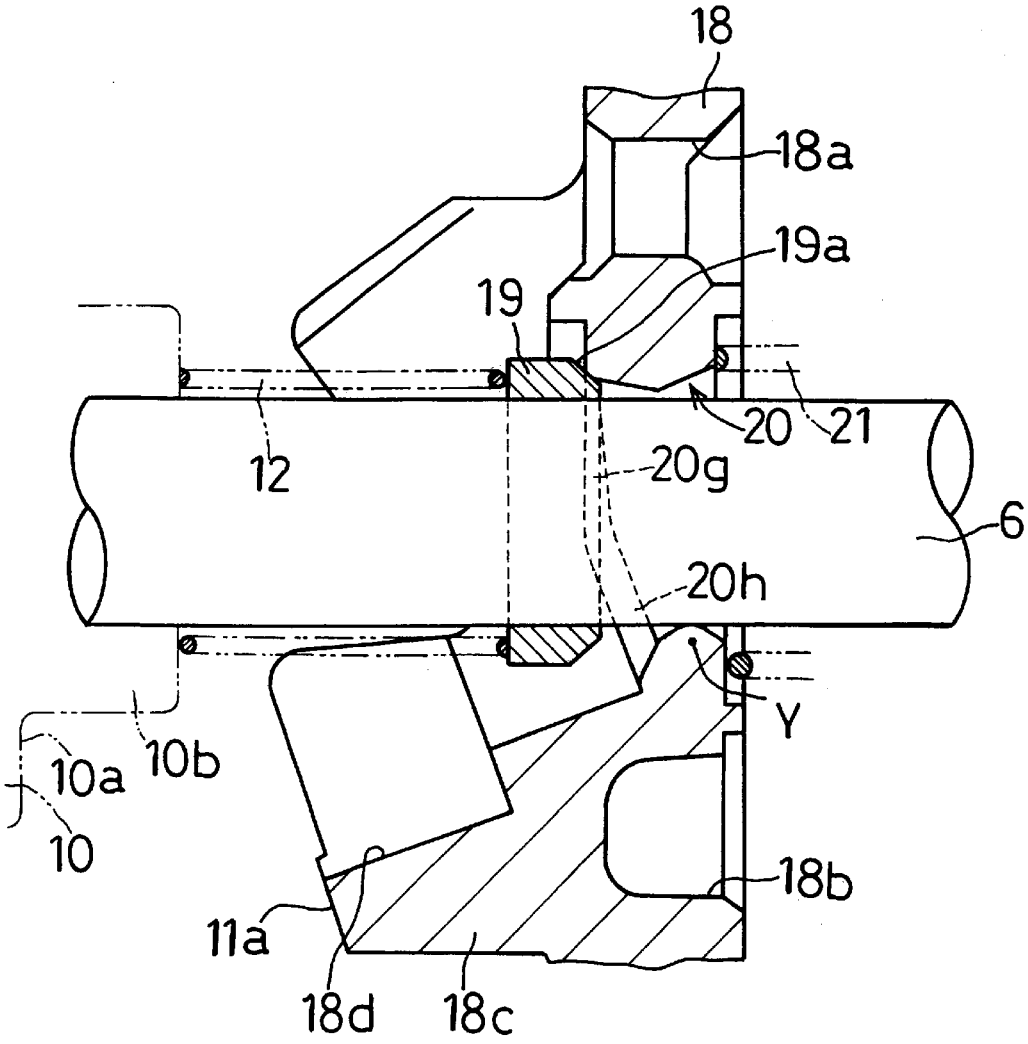
FIG. 1 is concerned with a compressor of a First Embodiment, and is a vertical cross sectional view of the major portion thereof at the minimum inclination angle.
Figure 11:
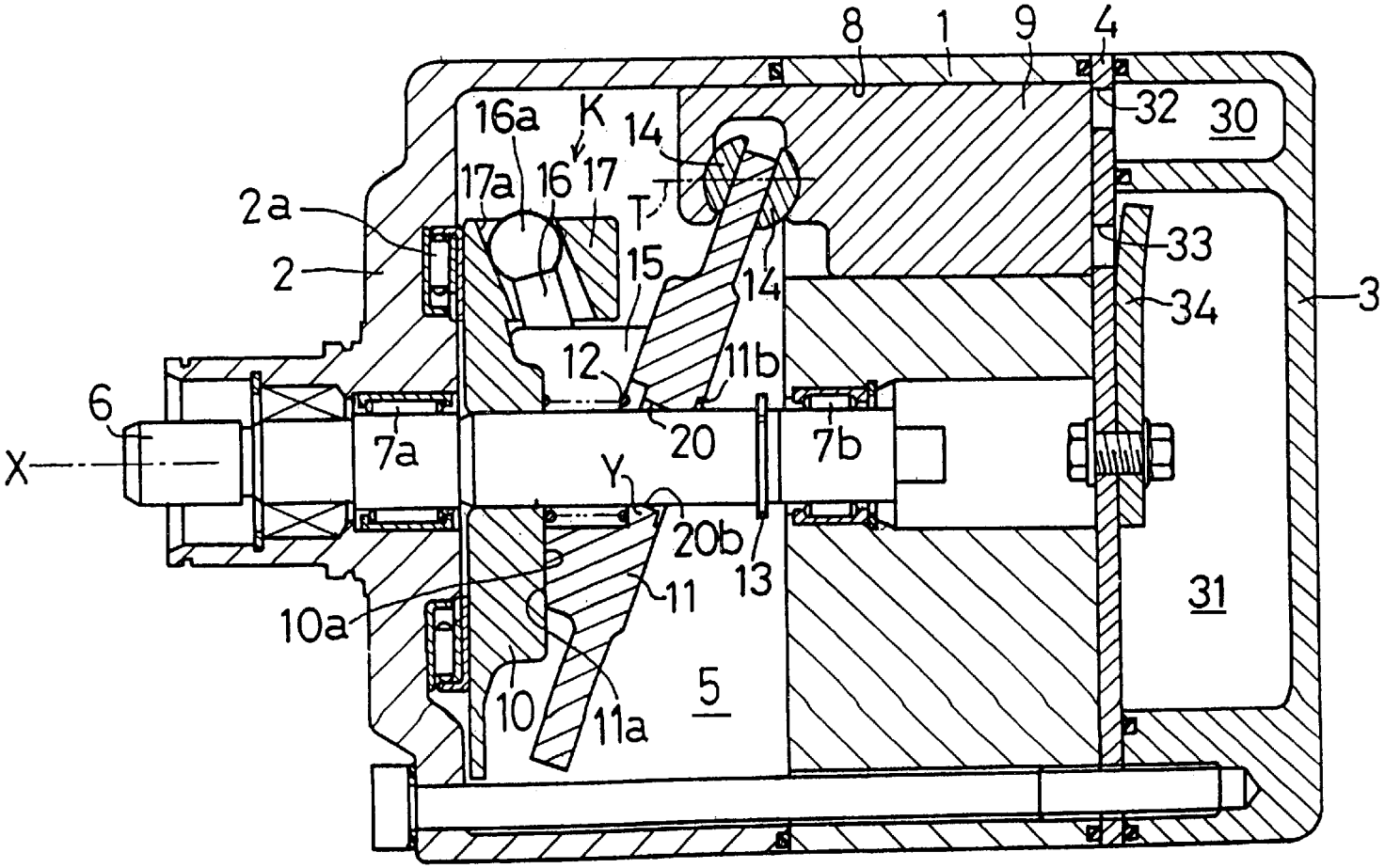
FIG. 11 (PRIOR ART)
FIG. 11 is a vertical cross sectional view of a conventional compressor.
Figure 12:
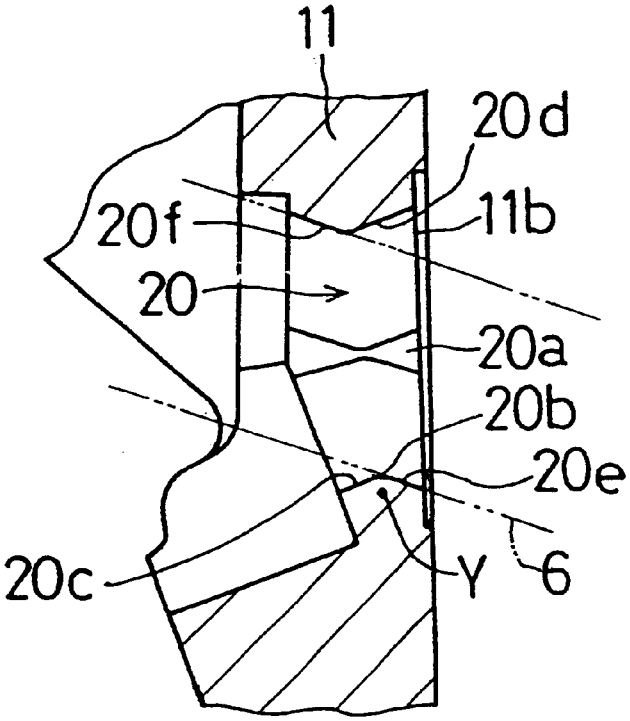
FIG. 12 (PRIOR ART)
FIG. 12 is a vertical cross sectional view of the major portion of a swash plate, which is concerned with the conventional compressor.

The compressor of the First Embodiment has a basic constitution, which is substantially identical with the constitution illustrated in FIG. 11 and FIG. 12, and differs therefrom in that it employs a swash plate 18 and a washer 19, which serves as the aligning member, as illustrated in FIGS. 1–6, and in that it employs a return spring 21 as illustrated in FIG. 1.

Figure 2:
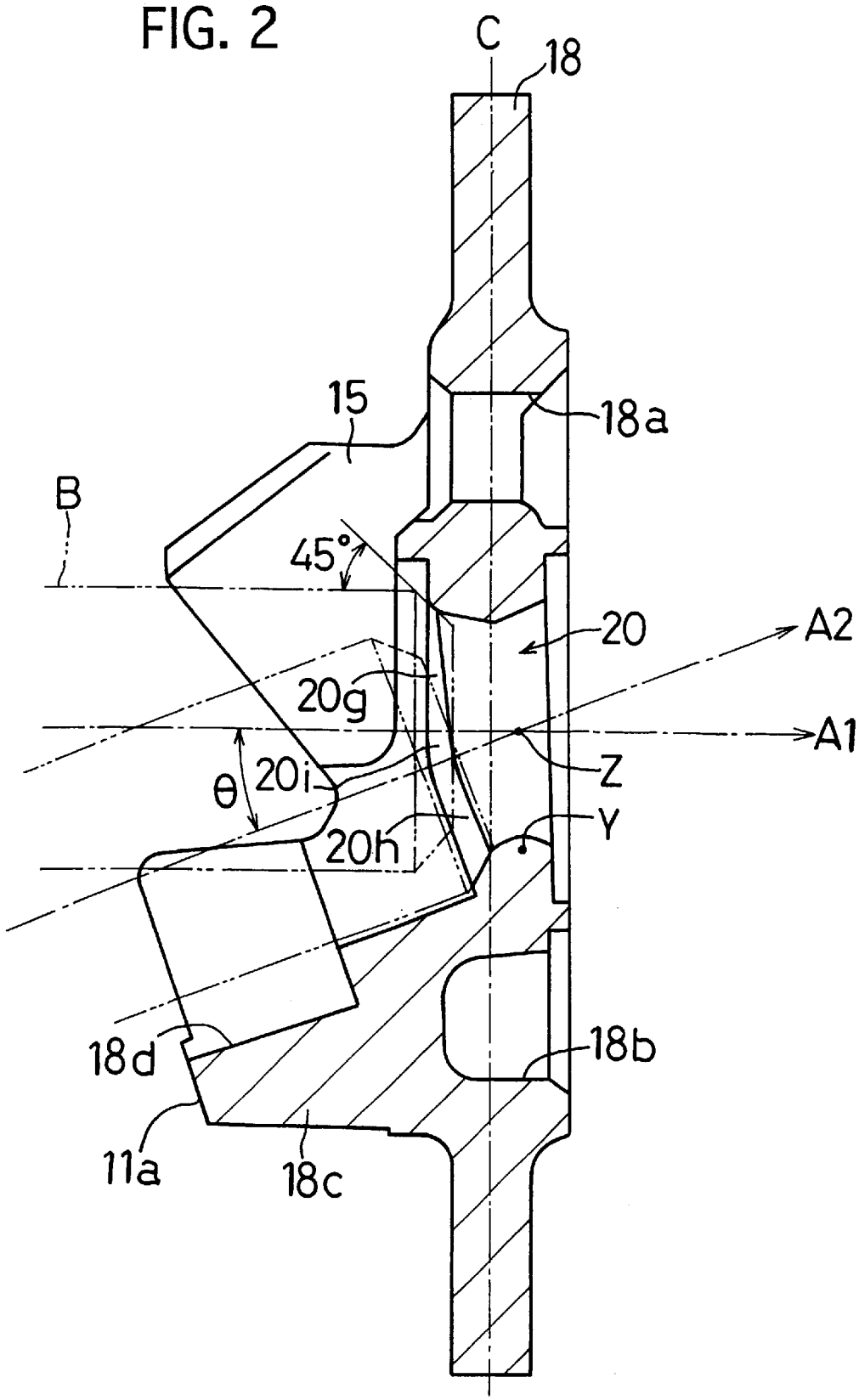
FIG. 2 is a vertical cross sectional view of a swash plate, which is concerned with the compressor of the First Embodiment.
Figure 3:
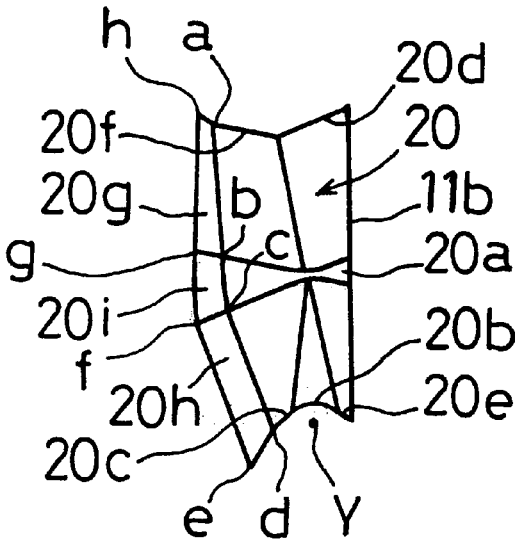
FIG. 3 is a view for illustrating an inner surface of a through hole of the swash plate, which is concerned with the compressor of the First Embodiment, only.
Figure 5:
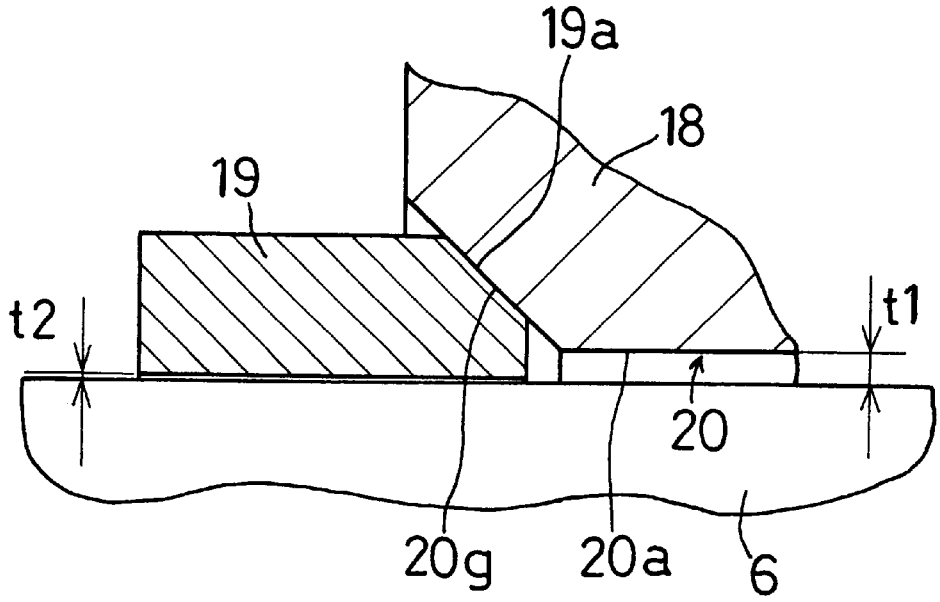
FIG. 5 is concerned with the compressor of the First Embodiment, and is an enlarged cross sectional view of the major portion thereof at the minimum inclination angle.

In the swash plate 18, which this compressor employs, as illustrated in FIG. 1 and FIG. 2, a through hole 20 is drilled through similarly to the compressor as illustrated in FIG. 11 and FIG. 12. That is, in this through hole 20, as illustrated in FIG. 3, a supporting portion 20*b* is formed as an arc shape about a swing-shaft center Y, and regulatory surfaces 20*a*, 20*a*, which extend parallely to a shaft center X, are formed flatly in the side surfaces. The swing-shaft center Y extends in a vertical direction with respect to the shaft center X shown in FIG. 11, and is set beyond a side of the driving shaft 6, the side facing hinge mechanisms K, K, while interposing the shaft center X therebetween. The regulatory surfaces 20*a*, 20*a* of such a through hole 20 are, as illustrated in FIG. 5, held while providing a clearance t1 of certain extent between themselves and the driving shaft 6 so that it is possible to vary the postures and positions, which are accompanied by the inclination-angle displacement of the swash plate 18. Since the postures and positions, which are accompanied by the inclination-angle displacement of the swash plate 18, are made variable, and since the through hole 20 is formed as a complicated configuration, such a clearance t1 is large comparatively.

The through hole 20 of the swash plate 18 in this compressor differs from the through hole 20 of the swash plate 11 in the conventional compressor in terms of the following features. Namely, in this compressor, as illustrated in FIG. 2 and FIG. 3, in a forward (The side of a rotor 10 is regarded as forward. Hereinafter, the notation is the same.) rim portion of the through hole 20, tapered surfaces 20*g*, 20*h* are formed which are formed as a minor diameter on an inner side of the swash plate 18, and which have an opening angle of 45°, and the portion between both of the tapered surfaces 20*g*, 20*h* is made continuous by a smooth curved surface 20*i*.

Both of such tapered surfaces 20*g*, 20*h* as well as the smooth curved surface 20*i* are formed as hereinafter described. First, as illustrated in FIG. 2, a cutting tool B is prepared which has a tapered processed surface having an opening angle of 45° at the leading end, after forming the through hole 20, shown in FIG. 12, in the swash plate 18, the cutting tool B is advanced from the forward side with respect to the swash plate 18 so that the axial center of the cutting tool B goes along a center line A1, which is disposed in a direction vertically crossing a central plane C of the swash plate 18. On this occasion, the center line A1 coincides with the shaft center X. Thus, as illustrated in FIG. 3, on a side of a top-dead-center position T of the swash plate 18, a tapered surface 20*g* is formed which is surrounded by signs a, b, g and h.

Then, as illustrated in FIG. 2, the swash plate 18 is swung gently about a rotary center z, which takes a distance, being equal to the distance from the central plane C to the swing-shaft center Y, on the center line A1 so that the axial center of the cutting tool B is placed on a center line A2. Note that, without swinging the swash plate 18, it is possible to swing the axial center of the cutting tool B. On this occasion, an angle θ between the center line A1 and the center line A2 is made into a displacement-variable angle, which is a difference between the maximum inclination angle and the minimum inclination angle. Thus, as illustrated in FIG. 3, a smooth curved surface 20*i* is formed which is surrounded by signs b, c, f and g. Moreover, on a bottom-dead-center side of the swash plate 18, a tapered surface 20*h* is formed which is surrounded by signs c, d, e and f. Note that it is possible to form the tapered surface 20*g*, and so forth, by operations reverse to this procedure.

On these occasions, the angle θ between the center line A1 and the center line A2 can be broadened slightly to the opposite sides, and can be made slightly larger than the displacement-variable angle of the swash plate 18. Specifically, it is possible to enlarge it by 1–2° on the side of the center line A1, and to enlarge it by 1–15° on the side of the center line A2. If such is the case, the inclination-angle displacement is not obstructed by the contact between the swash plate 18 and the washer 19, and thereby-the capacity of the compressor does not decrease.

Note that the aforementioned rotary center Z in the processing cannot necessarily be placed on the center line A1. It is possible to place it on a side of the swing-shaft center Y beyond the center line A1 or at the opposite-side position. Moreover, it is possible to displace it in an axial direction.

Note that, after the cutting tool B is advanced from the forward side with respect to the swash plate 18 so that the axial center of the cutting tool B goes along the center line A1, it is possible to temporarily retract the cutting tool B, then to swing the swash plate 18 or the cutting tool B so that the axial center of the cutting tool B is superimposed on the center line A2, and then again to advance the cutting tool B from the forward side with respect to the swash plate 18 so that the axial center of the cutting tool B goes along the center line A2. If such is the case, the smooth curved surface 20*i*, which is surrounded by signs b, c, f and g, shown in FIG. 3, is not formed, but a tapered surface, which is surrounded by signs a, c, f and h, and a tapered surface, which is surrounded by signs c, d, e and f, are formed, and the portion between both of the tapered surfaces is made continuous by an obtuse angle. Since the relative wear between the swash plate 18 and the driving shaft 6 is less likely to occur when the portion between the tapered surfaces 20*g*, 20*h* is made continuous by the smooth curved surface 20*i*, it is further preferable to process the tapered surface 20*g*, and so forth, by the former procedure.

Figure 6:
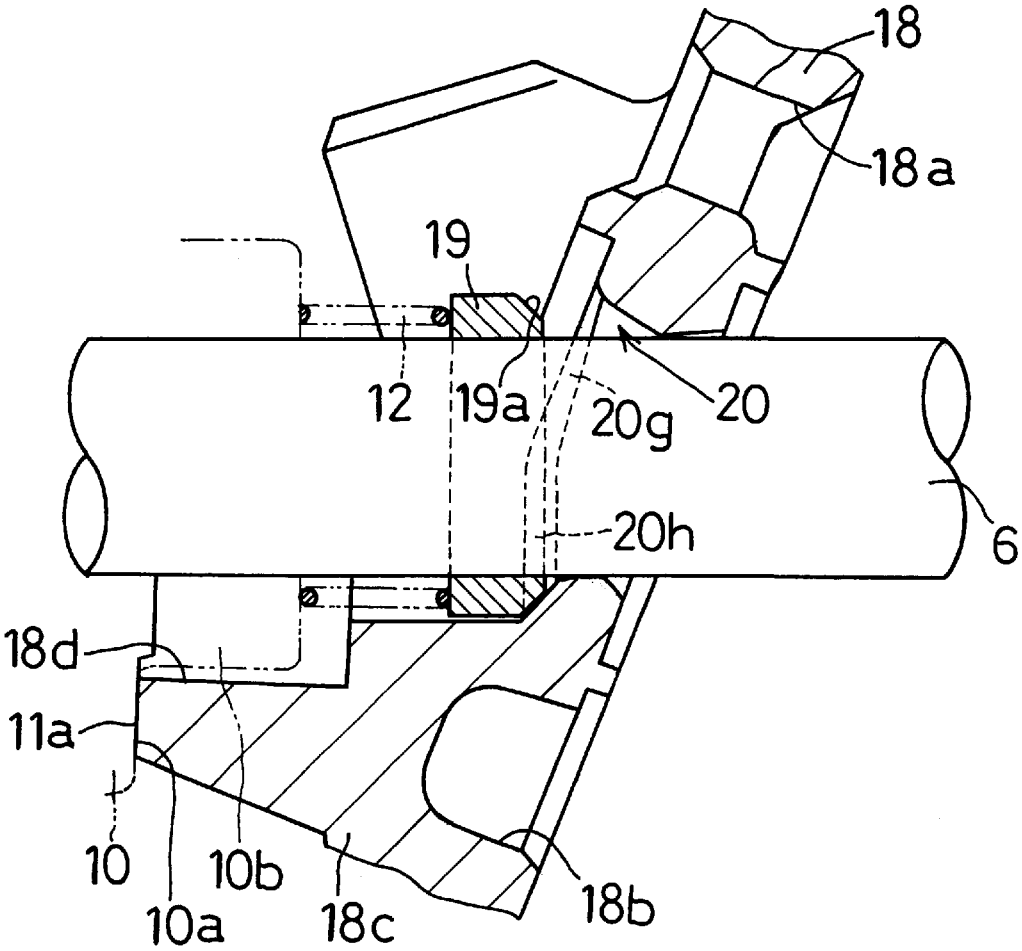
FIG. 6 is concerned with the compressor of the First Embodiment, and is a vertical cross sectional view of the major portion thereof at the maximum inclination angle.

As additional notes, in the swash plate 18, as illustrated in FIG. 2, a through hole 18*a* is drilled through on a side of the top-dead-center position T for balancing, light-weighting and positioning in the processing, and a spot facing 18*b* is dented on a side of the bottom-dead-center position for balancing and light-weighting. Moreover, in a weight 18*c*, which is disposed integrally on a side of the bottom-dead-center position of the swash plate 18, as illustrated in FIG. 1, a concaved portion 18*d* is dented which avoids a boss 10*b* formed at the rear end of the rotor 10, and, below the concaved portion 18*d*, as illustrated in FIG. 6, a forward end surface 11*a* is formed which contacts with a rear end surface 10*a* of the rotor 10 so as to regulate a further inclination movement in the inclination-angle enlarging direction.

Figures 4A, 4B, 4C:
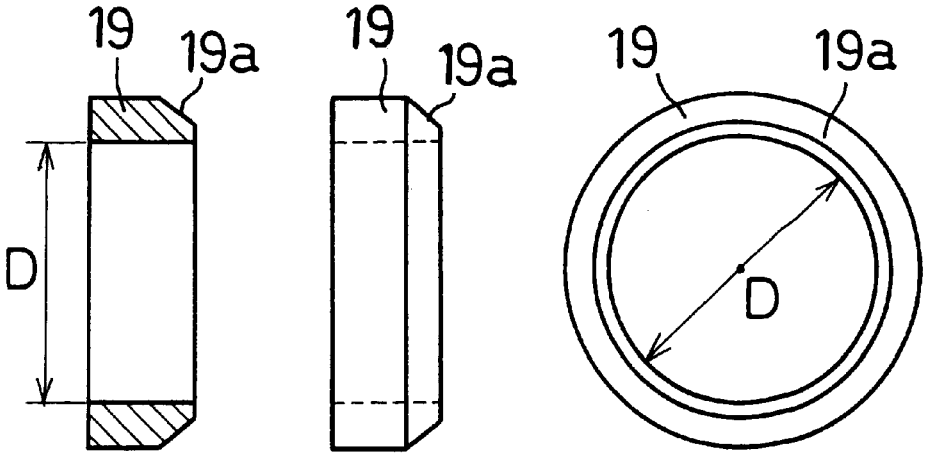
FIG. 4A is a cross sectional view of a washer, which is concerned with the compressor of the First Embodiment.
FIG. 4B is a side view of the washer, which is concerned with the compressor of the First Embodiment.
FIG. 4C is a front view of the washer, which is concerned with the compressor of the First Embodiment.

Moreover, in this compressor, the washer 19 is employed which is illustrated in FIG. 1 and FIGS. 4–6. This washer 19, as illustrated in FIG. 4, is a substantially cylinder-shaped one, which has an inside diameter D slightly larger than an outside diameter of a portion in the driving shaft 18, portion which is positioned in the through hole 20 of the swash plate 18. Here, the extent that the inside diameter D is larger than the outside diameter of the portion of the driving shaft 6, as illustrated in FIG. 5, is a clearance t2, which results from a dimension over which the washer 19, fitted with the driving shaft 6, is slidable in the axial direction as well as a tolerance, required in processing this dimension. Since the processing of the inside diameter D is a simple cylinder-surface processing, such a clearance t2 can be made smaller at ease than the clearance t1 between the regulatory surfaces 20*a*, 20*a* of the through hole 20 in the aforementioned swash plate 18. As illustrated in FIG. 4, on a backward rim portion of this washer 19 as well, a tapered surface 19*a*, which is made into a minor diameter on an inner side of the swash plate 18 and which has an opening angle of 45°, is formed. Such a washer 19, as illustrated in FIG. 1, is urged to the backward side by an inclination-angle reducing spring 12, which is disposed in-between the rotor 10.

Note that, in this compressor, as illustrated in FIG. 1, the return spring 21 is employed. This return spring 21 urges the swash plate 18 from the backward side in such a direction that the inclination angle of the swash plate 18 enlarges from the minimum inclination angle to an angle, which exceeds a returnable limit angle.

In the thus constituted compressor as well, with reference to FIG. 11, when the rotor 10 and the swash plate 18 are rotated at a specified angle accompanied by the driving of the driving shaft 6, the pistons 9 are reciprocated in the cylinder bores 8. Thus, a refrigerant gas is suctioned into the compression chamber from the inlet chambers 30, the refrigerant gas is discharged into the outlet chamber 31 after it is compressed. And, the angle of the swash plate 18 is displaced by the pressure adjustment in the crack chamber 5 with the control valve. In the meantime, as illustrated in FIG. 5, since the regulatory surfaces 20*a*, 20*a* of the through hole 20 in the swash plate 18 are held by providing the clearance t1 of certain extent in-between the driving shaft 16, it is possible to vary the postures and positions, which are accompanied by the inclination-angle displacement of the swash plate 18. And, the outlet capacity of the refrigerant gas, which is discharged into the outlet chamber 31, is controlled.

And, in this compressor, as illustrated in FIG. 1, in the case where the compression operation is not carried out, or in the case where the compression operation is carried out at a small capacity regarded as zero substantially, the compression load does not act onto the swash plate 18, or hardly acts thereonto. However, in this compressor, as a characteristic action, the washer 19, which has the tapered surface 19*a* whose minor-diameter side is positioned on an inner side of the swash plate 18, moves toward the side of the swash plate 18 by the urging force of the inclination-angle reducing spring 12, as illustrated in FIG. 5, the tapered surface 19*a* of the washer 19 contacts with the tapered surface 20*g* of the swash plate 18 with each other in a surface-to-surface manner so as to align the swash plate 18. Hence, the clearance t1, which the regulatory surfaces 20*a*, 20*a* of the through hole 20 have in-between the driving shaft 6, is buried and absorbed.

Hence, in this compressor, under these circumstances, even when large vibrations are applied from a vehicle, an engine, etc., accompanied by the travelling of the vehicle, the swash plate 18 does not collide repeatedly with the driving shaft 6, noises and vibrations do not arise, and the wears are less likely to arise at colliding portions.

Note that, as illustrated in FIG. 6, in a case where this compressor carries out the compression operation at a large capacity of certain extent, the swash plate 18 contacts with the driving shaft 6 by a compression load, and displaces the inclination angle under the circumstances that the tapered surface 19*a* of the washer 19 contacts with the smooth curved surface 20*i* of the swash plate 18.

Hence, this compressor can prevent the drawbacks, such as the noises, etc., without obstructing the inclination-angle displacement of the swash plate 18, which is accompanied by the variable capacity, in the case where it does not carry out the compression operation or in the case where it carries out the compression operation at a small outlet capacity regarded as zero substantially.

In addition, since the inclination-angle reducing spring 12 urges the washer 19, an urging member, which urges the washer 19 only, is obviated, the reduction of the product cost is realized by reducing the number of the component parts. The other operations and effects are the same as those of the compressor set forth in the aforementioned publication.

(Second Embodiment)

Figure 7A:
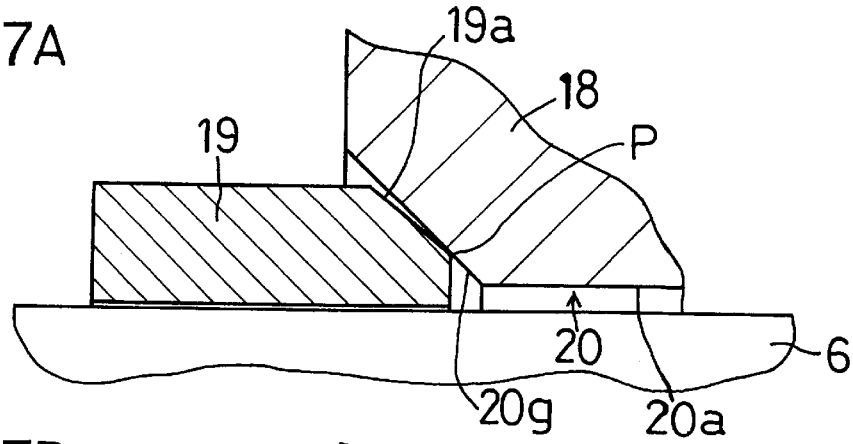
FIG. 7A is concerned with the compressor of the First Embodiment, and is an enlarged cross sectional view of the major portion thereof at the minimum inclination angle.
Figure 7B:
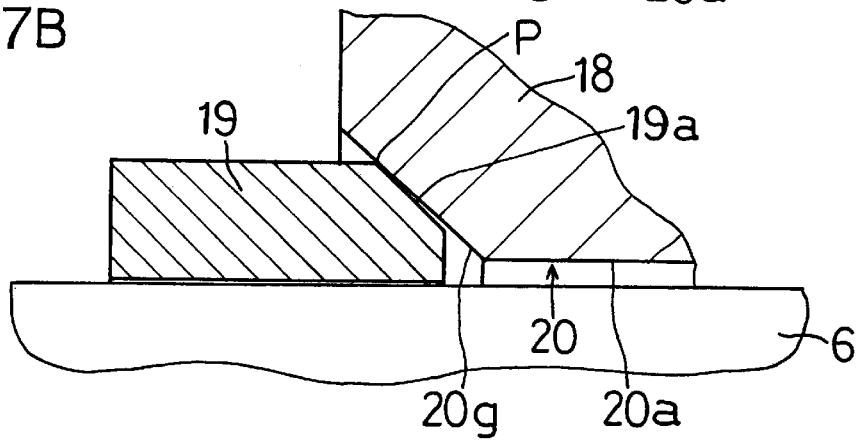
FIG. 7B is concerned with the compressor of the First Embodiment, and is an enlarged cross sectional view of the major portion thereof at the minimum inclination angle.

Like the compressor in the First Embodiment, it is not easy to process the tapered surfaces 20*g*, 20*h* in the through hole 20 of the swash plate 18 and the tapered surface 19 of the washer 19 with an equal opening angle. Moreover, even when the tapered surfaces 20*g*, 20*h* and the tapered surface 19 are processed with an equal opening angle, after assembling a compressor, because of the dimension for sliding, the dimensional tolerance, etc., it is probable that these tapered surfaces 20*g*, 20*h* contact with the tapered surface 19 inclinedly. In these cases, as illustrated in FIGS. 7A and B, a corner P of the washer 19 is likely to contact with the tapered surfaces 20*g*, 20*h*, and to cause wear between both of them.

Figure 8:
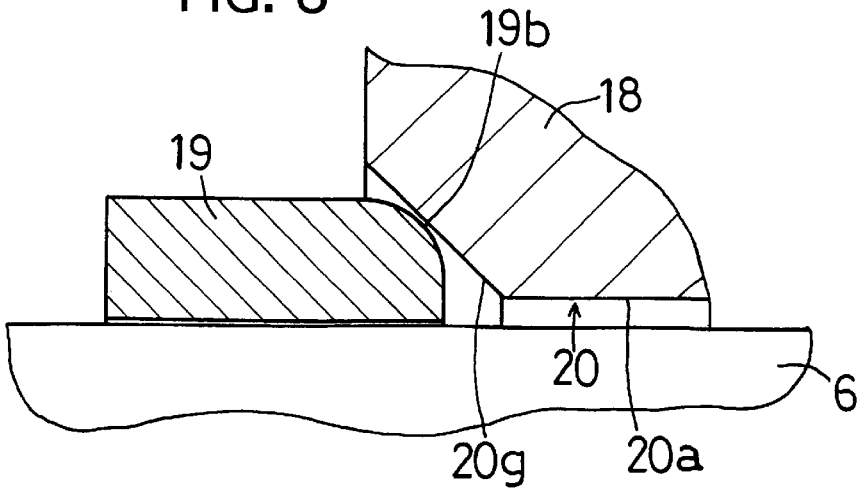
FIG. 8 is concerned with a compressor of a Second Embodiment, and is an enlarged cross sectional view of the major portion thereof at the minimum inclination angle.

Hence, in the compressor of the Second Embodiment, as illustrated in FIG. 8, a portion, at which the swash plate 18 contacts with the washer 19, is formed as the tapered surface 20*g*, which makes a minor diameter on an inner side of the swash plate 18, and a portion, at which the washer 19 contacts with the swash plate 18, is formed as a convexed curved surface 19*b*. The other constitutions are the same as those of the First Embodiment.

When it is such a compressor, it is easy to process and accordingly to realize the reduction of the production cost. The other operations and effects are the same as those of the First Embodiment.

(Third Embodiment)

Figure 9:
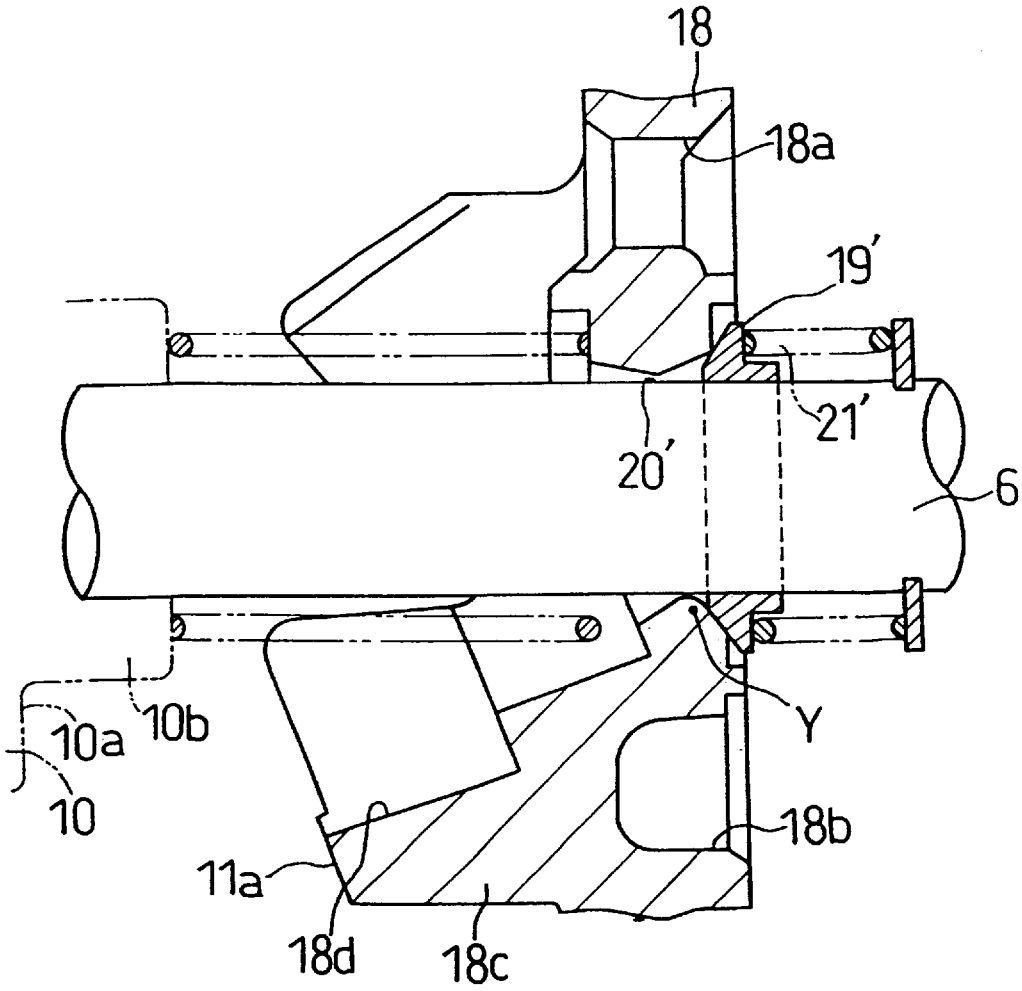
FIG. 9 is concerned with a compressor of a Third Embodiment, and is a vertical cross sectional view of the major portion thereof at the minimum inclination angle.

As illustrated in FIG. 9, the aligning of the swash plate 18 can be carried out from the backward side of a through hole 20' in the swash plate 18 by using a washer 19'. The washer 19' has a tapered surface, which contacts with the backward side of the through hole 20', on the forward side, and has a seating surface for a return spring 21' on the backward side. And, the return spring 21' is supported by a circlip 13 on the backward end side, and the washer 19' is urged toward the forward side by the return spring 21'. Note that the washer 19' can be supported directly with the circlip 13.

(Fourth Embodiment)

Figure 10:
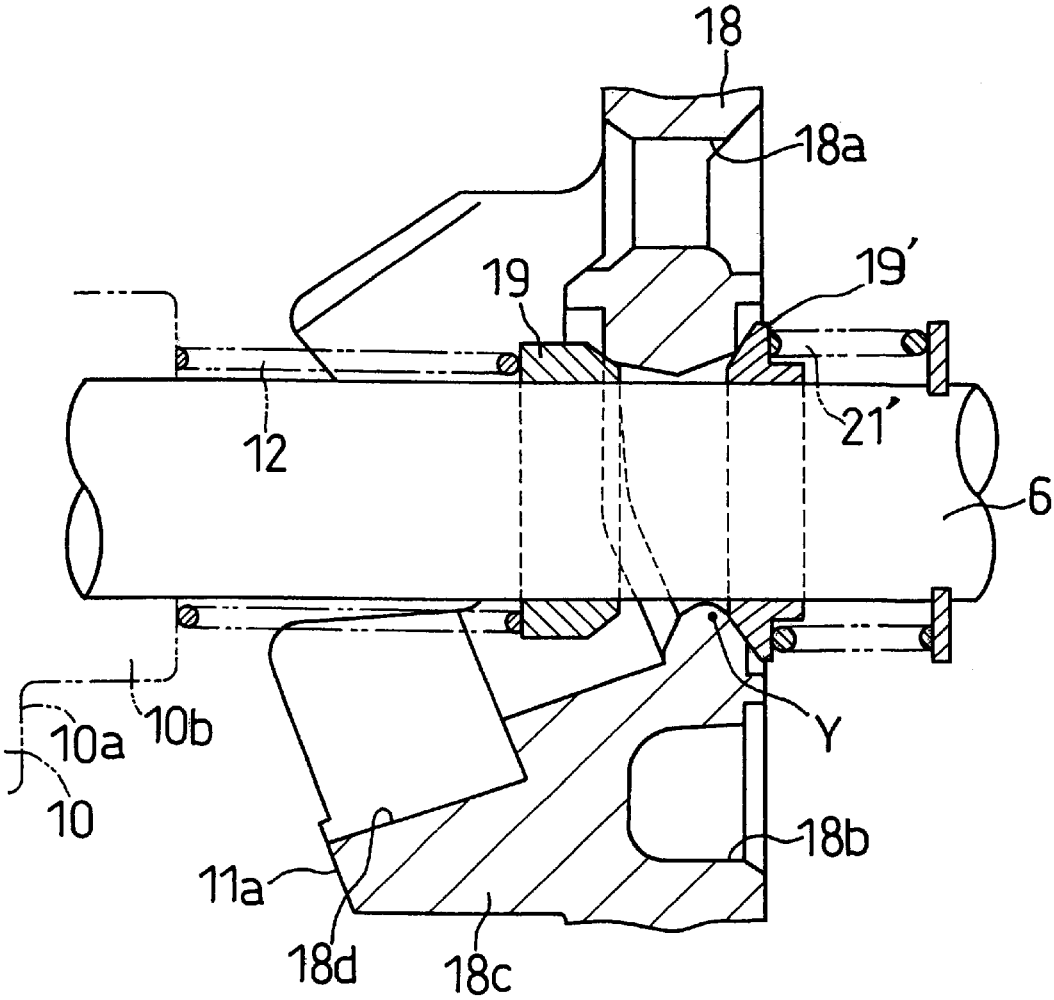
FIG. 10 is concerned with a compressor of a Fourth Embodiment, and is a vertical cross sectional view of the major portion thereof at the minimum inclination angle.

As illustrated in FIG. 10, the aligning of the swash plate 18 can be carried out by disposing the aforementioned washer 19 (a first aligning member) and the aforementioned washer 19' (a second aligning member) on the both of the forward side and backward side of the swash plate 18. Note that the washer 19 is urged from the forward side to the backward side by the inclination-angle reducing spring 12 (an urging means), and that the washer 19' is urged from the backward side to the forward side by the return spring 21' (an urging means). Since the aligning members are thus disposed on both of the forward side and backward side, the swash plate 18 is aligned much more stably.

As having described so far, in accordance with the variable-capacity swash-plate type compressor of present invention, since it is provided with the aligning member, which contacts with the swash plate, it is possible, without obstructing the inclination-angle displacement accompanied by the variable capacity, to prevent the noises, the vibrations of the swash plate, etc., in the case where the compression operation is not carried out or in the case where the compression operation is carried out at a small outlet capacity regarded as zero substantially.

What is claimed is:

1. A variable-capacity swash-plate type compressor, which is constituted so that a crank chamber, inlet chambers, an outlet chamber and cylinder bores connected therewith are demarcated and formed in a housing, so that pistons are accommodated reciprocatably in the respective cylinder bores, respectively, so that a rotor, positioned in said crank chamber, is supported synchronously rotatably onto a driving shaft, supported by the housing, and a swash plate, connected thereto by way of the rotor and a hinge mechanism, is fitted therewith so as to make an inclination angle variable, so that a connecting mechanism, transforming a to-and-fro swinging movement of said swash plate into reciprocating movements of the respective pistons, is interposed between the swash plate and said pistons, and so that the inclination angle of said swash plate is controlled by a pressure in said crank chamber so as to vary an outlet capacity, wherein it is characterized in that an aligning member, which contacts with said swash plate to align said swash plate, is interposed between said driving shaft and said swash plate;

an urging means for urging said aligning member onto a side of said swash plate, said urging means is an inclination-angle reducing spring, which urges the swash plate in such a direction that the inclination angle is reduced from the maximum inclination angle to the minimum inclination angle; and said aligning member is disposed between said rotor and said swash plate.

2. A variable-capacity swash-plate type compressor, which is constituted so that a crank chamber, inlet chambers, an outlet chamber and cylinder bores connected therewith are demarcated and formed in a housing, so that pistons are accommodated reciprocatably in the respective cylinder bores, respectively, so that a rotor, positioned in said crank chamber, is supported synchronously rotatably onto a driving shaft, supported by the housing, and a swash plate, connected thereto by way of the rotor and a hinge mechanism, is fitted therewith so as to make an inclination angle variable, so that a connecting mechanism, transforming a to-and-fro swinging movement of said swash plate into reciprocating movements of the respective pistons, is interposed between the swash plate and said pistons, and so that the inclination angle of said swash plate and said pistons, and so that the inclination angle of said swash plate is controlled by a pressure in said crank chamber so as to vary an outlet capacity, wherein it is characterized in that an aligning member, which contacts with said swashplate to align said swash plate, is interposed between said driving shaft and said swash plate;

said aligning member includes a first aligning member, which is disposed between said rotor and said swash plate, and a second aligning member, which is disposed on an opposite side of the rotor with respect to said swash plate; and an urging means for urging said aligning member onto a side of said swash plate, said urging means includes an inclination-angle reducing spring, which urges the first aligning member in such a direction that the inclination angle of the swash plate is reduced from the maximum inclination angle to the minimum inclination angle, and a return spring, which urges the second aligning member in such a direction that the inclination angle of the swash plate is enlarged from the minimum inclination angle to a limit angle or more.

3. The variable-capacity swash-plate type compressor set forth in either one of claim 1 or 2, wherein at least one portion, which is selected from the group consisting of a portion with which said swash plate contacts said aligning member and a portion with which said aligning member contacts said swash plate, is formed as a minor-diameter tapered surface on an inner side of the swash plate.

4. The variable-capacity swash-plate type compressor set forth in either one of claim 1 or 2, wherein one of a portion, with which said swash plate contacts said aligning member, and a portion, with which said aligning member contacts said swash plate, is formed as a minor-diameter tapered surface on an inner side of the swash plate, and the other one of them is formed as a convexed curved surface.

5. The variable-capacity swash-plate type compressor set forth in either one of claim 1 or 2 being characterized in that a through hole, into which the driving shaft is fitted, is formed through in the swash plate, the through hole is formed so as to permit an inclination-angle displacement of the swash plate over an entire control range about a swing-shaft center, which is set beyond a side of the driving shaft, side which faces the hinge mechanism, while interposing a shaft center therebetween, and the aligning member is fitted with the driving shaft.

* * * * *

UNITED STATES PATENT AND TRADEMARK OFFICE

CERTIFICATE OF CORRECTION

PATENT NO. : 6,524,079 B1
DATED : February 25, 2003
INVENTOR(S) : Kazuya Kimura et al.

It is certified that error appears in the above-identified patent and that said Letters Patent is hereby corrected as shown below:

Column 4,
Line 13, please delete “Lhe” and insert therefore -- the --

Column 12,
Lines 23, 30 and 37, please delete “claim” and insert therefore -- claims --.

Signed and Sealed this

Twenty-fourth Day of June, 2003

JAMES E. ROGAN
*Director of the United States Patent and Trademark Office*